United States Patent [19]

Wake et al.

[11] 4,181,109

[45] Jan. 1, 1980

[54] EXHAUST GAS RECIRCULATION APPARATUS

[75] Inventors: Junichi Wake, Yono; Hiroshi Matsuda, Sakado, both of Japan

[73] Assignee: Nissan Diesel Kogyo Company, Ltd., Ageo, Japan

[21] Appl. No.: 906,012

[22] Filed: May 15, 1978

[30] Foreign Application Priority Data

May 16, 1977 [JP] Japan ..... 52-56181

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,135,253 | 6/1964 | Muhlberg | 123/119 A |
| 3,916,857 | 11/1975 | Naito et al. | 123/119 A |
| 3,978,834 | 9/1976 | Arnauo et al. | 123/119 A |
| 3,980,064 | 9/1976 | Ariga et al. | 123/119 A |
| 4,020,809 | 5/1977 | Kern et al. | 123/119 A |
| 4,027,636 | 6/1977 | Yamamoto et al. | 123/119 A |

*Primary Examiner*—Wendell E. Burns
*Attorney, Agent, or Firm*—David G. Alexander

[57] ABSTRACT

An exhaust gas recirculation passageway leads from an engine exhaust passageway to an engine induction passageway downstream of a throttle valve. A fuel control member of an injection pump moves the throttle valve in the opening direction to reduce the vacuum in the induction passageway and thereby the amount of exhaust gas recirculation only when the fuel control member is moved beyond a predetermined position in the fuel increasing direction. A stopper limits movement of the throttle valve in the closing direction.

14 Claims, 7 Drawing Figures

EXHAUST GAS RECIRCULATION APPARATUS

BACKGROUND OF THE INVENTION

The present invention relates to an exhaust gas recirculation apparatus for an internal combustion engine such as of the Diesel type.

It is known in the prior art to provide a throttle valve in the induction passageway of an internal combustion engine, and connect an exhaust gas recirculation passageway between the engine exhaust passageway and the induction passageway just downstream of the throttle valve. The smaller the opening of the throttle valve, the greater the vacuum downstream thereof, the greater the pressure difference between the ends of the recirculation passageway and the greater the degree of exhaust gas recirculation.

Generally, a greater degree of exhaust gas recirculation is required at idling and low engine speeds than at higher speeds. For this reason, it has been known to connect the engine accelerator pedal or lever to the throttle valve in such a manner as to progressively open the throttle valve as the accelerator pedal is depressed to increase the engine speed. However, most modern Diesel engines are equipped with two speed governors which limit the engine speed to predetermined minimum and maximum values, with the accelerator pedal controlling the engine speed between the minimum and maximum values. At the minimum engine speed, or idling speed, the accelerator pedal is maintained in a minimum fuel position and the amount of fuel injected into the engine is determined by the governor in accordance with the engine load.

Under high load engine operation, the accelerator pedal must be depressed to inject more fuel into the engine than under low load operation to achieve a given engine speed. Thus, the throttle valve is more open and the exhaust gas recirculation smaller under high load conditions than under low load conditions.

If the throttle valve is set to provide proper exhaust gas recirculation at idle speed, the amount of recirculation will be insufficient at normal speeds since the throttle valve will be opened too wide and the induction vacuum will be too low. This causes formation of $NO_x$ pollutants. On the other hand, if the throttle valve is set to provide proper recirculation at normal operating speeds, the recirculation will be too great at idling speed since the throttle valve will be almost completely closed and the induction vacuum too high. This causes instable combustion, rough running and the formation of CO and HC pollutants.

SUMMARY OF THE INVENTION

The present invention overcomes the drawbacks of the prior art by providing an improved exhaust gas recirculation apparatus for an internal combustion engine having a fuel control member, an induction passageway and an exhaust passageway. The present apparatus comprises a throttle valve movably disposed in the induction passageway and a recirculation passageway leading from the exhaust passageway to the induction passageway downstream of the throttle valve. Stopper means limit movement of the throttle valve in a closing direction. Linkage means connect the fuel control member to the throttle valve in such a manner that movement of the fuel control member in a fuel increasing direction beyond a predetermined position causes the throttle valve to move in an opening direction.

It is an object of the present invention to provide an improved exhaust gas recirculation apparatus for an internal combustion engine which provides the proper amount of exhaust gas recirculation at all values of engine speed and load.

It is another object of the present invention to provide an exhaust gas recirculation apparatus which is effective in operation yet simple in construction and economical to manufacture on a commercial production basis.

It is another object of the present invention to provide a generally improved exhaust gas recirculation apparatus.

Other objects, together with the foregoing, are attained in the embodiment described in the following description and illustrated in the accompanying drawing.

DESCRIPTION OF THE PREFERRED EMBODIMENT

While the exhaust gas recirculation apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
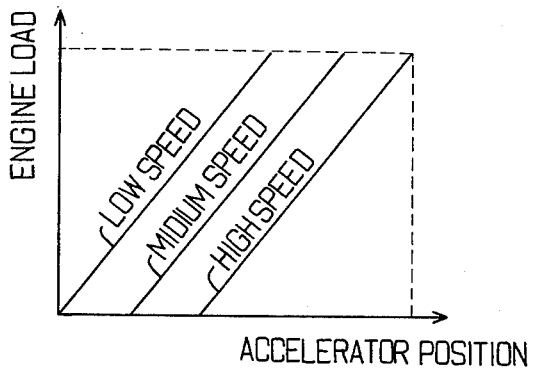
FIG. 1 is a graph illustrating the operation of a Diesel internal combustion engine.

FIG. 1 shows the relationship between the position of an accelerator pedal (not shown) of an internal combustion engine of the Diesel type, the engine load and the engine speed. It will be seen that the accelerator pedal must be depressed to different positions to maintain particular low, medium and high engine speeds as a function of engine load. As the engine load increases, the accelerator pedal must be depressed to a greater extent to inject more fuel into the engine to maintain a particular speed. The accelerator pedal must be further depressed to increase the engine speed under constant load operation. For these reasons, exhaust gas recirculation control based on accelerator pedal position will not provide the proper amount of exhaust gas recirculation under various conditions of engine speed and load.

Figure 2:
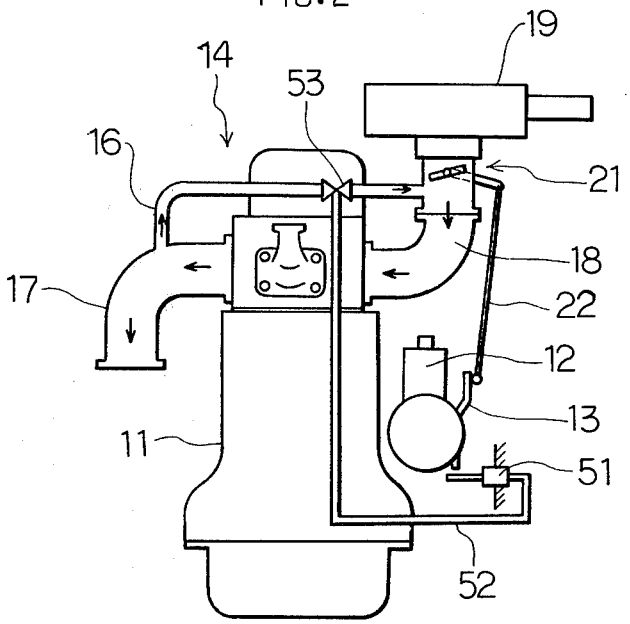
FIG. 2 is a front elevation of a Diesel engine equipped with an exhaust gas recirculation apparatus embodying the present invention.
Figure 3:
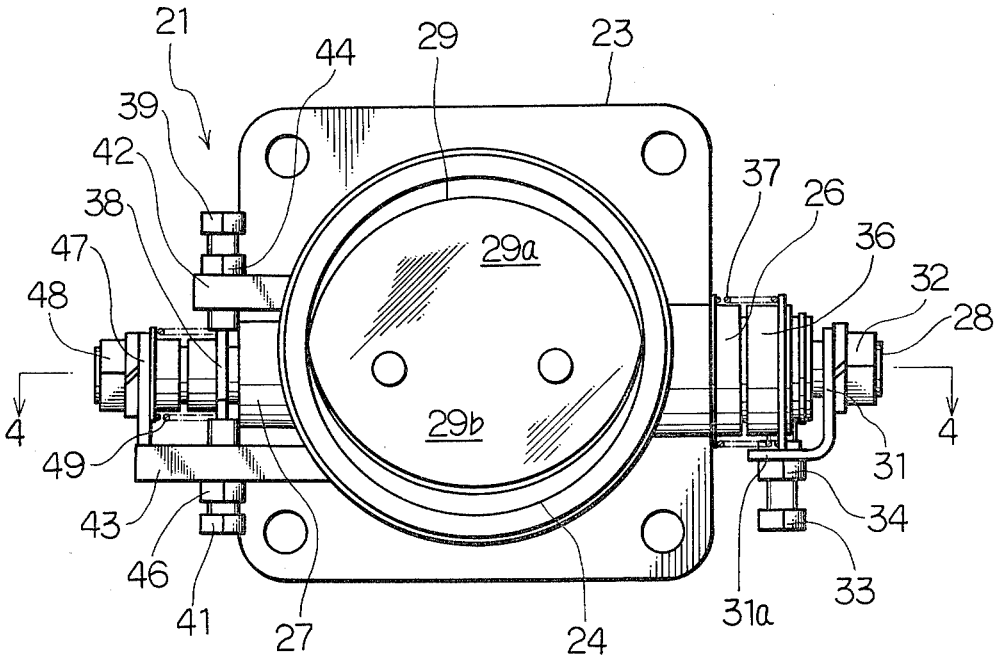
FIG. 3 is a top plan view of a throttle valve of the present apparatus.
Figure 4:
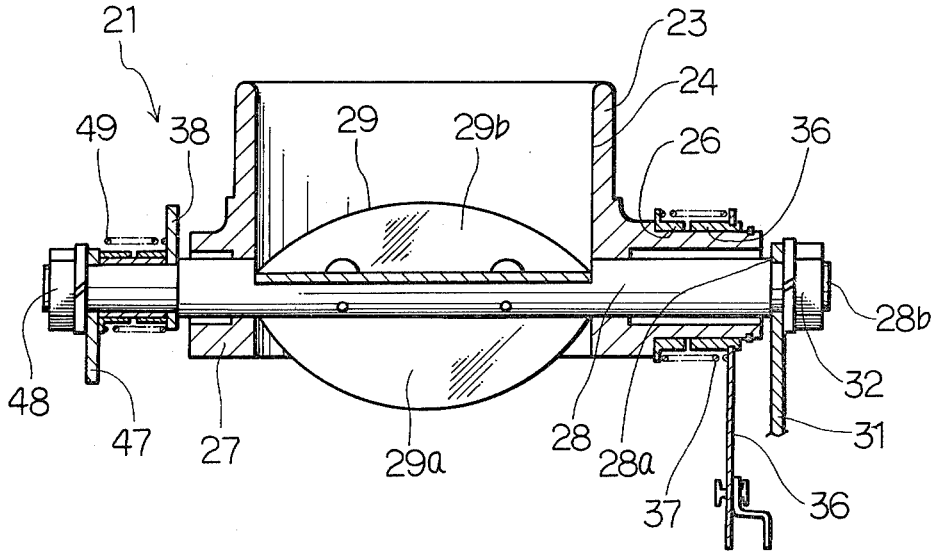
FIG. 4 is a section on a line 4—4 of FIG. 3.

FIG. 2 shows a Diesel internal combustion engine 11 equipped with a fuel injection governor 12 which limits the minimum and maximum operating speeds of the engine 11. Although not shown, an accelerator pedal controls the engine speed between the maximum and minimum values, the accelerator pedal constituting a mechanical input to the governor 12. A fuel control member 13 constitutes a mechanical output of the governor 12 and controls the amount of fuel injected into the engine 11. In other words, the amount of fuel injection is determined by the position of the fuel control member 13.

An exhaust gas recirculation apparatus embodying the present invention is generally designated by the reference numeral 14 and comprises an exhaust gas recirculation conduit or passageway 16 connected between an exhaust passageway 17 and an intake or induction passageway 18 of the engine 11. An air cleaner 19 is illustrated at the opening of the induction passageway 18. Air is drawn into the engine 11 through the air cleaner 19 and induction passageway 18. Although not shown, a fuel injection apparatus controlled by the fuel injection pump 12 serves to inject fuel into the induction passageway 18. The fuel-air mixture is burned in the engine 11 to produce mechanical power. The products of combustion, constituting the exhaust gas, are discharged from the engine 11 through the exhaust passageway 17.

In accordance with the present invention, a throttle valve 21 is provided to the induction passageway 18 upstream of the outlet of the recirculation passageway 16. Since the level of induction vacuum in a Diesel engine is comparatively low, the throttle valve 21 functions to create a flow restriction which serves to increase the level of vacuum in the vicinity of the throttle valve 21. The difference between the exhaust gas pressure in the exhaust passageway 17 and the vacuum in the induction passageway 18 causes a certain amount of exhaust gas to be recirculated into the induction passageway 18 and engine 11 from the exhaust passageway 17 through the recirculation passageway 16. This recirculated exhaust gas lowers the combustion temperature in the engine 11 and prevents the formation of $NO_x$ pollutants. The throttle valve 21 is controlled by the fuel control member 13 through a link 22 in a manner which will be described in detail below.

The amount of exhaust gas recirculation depends on the level of exhaust gas pressure in the exhaust passageway 17 and the level of vacuum in the induction passageway 18. The greater the levels of exhaust gas pressure and induction vacuum the greater the amount of exhaust gas recirculation. Since the throttle valve 21 functions as a flow restriction which increases the velocity of induction air flow, the smaller the opening of the throttle valve 21 the greater the level of vacuum and the greater the amount of exhaust gas recirculation.

The detailed construction of the throttle valve 21 is shown in FIGS. 3 to 6. The throttle valve 21 comprises a housing 23 formed with a bore 24 which constitutes part of the induction passageway 18. Bosses 26 and 27 are formed on the opposite sides of the housing 23. A valve shaft 28 is rotatably supported inside the bore 24 by the bosses 26 and 27 perpendicular to the axis of the bore 24. A generally round valve plate 29 is fixed to the valve shaft 28 in an eccentric manner such that a lower portion **29*a* thereof is larger than an upper portion 29*b*** thereof.

An arm 31 is fixed to one end of the valve shaft 28. Part of the arm 31 is bent inwardly toward the housing 23 as indicated at **31*a*. The arm 31 is held tightly on the end of the shaft 28 by means of a shoulder 28*a* and threads 28*b* formed on the shaft 28 and a nut 32 screwed onto the threads 28*b***.

An adjusting screw 33 extends through a threaded hole (not designated) in the portion **31*a* of the arm 31 and is held in the desired position by a locknut 34. A generally sector shaped arm 36 is rotatably mounted on the boss 26 and pivotally connected to the link 22. The arm 36 is aligned with the screw 33 in the axial direction of the shaft 28. A torsion spring 37 connected between the housing 23 and the arm 36 urges the arm 36 counterclockwise as viewed in FIG. 5, or away from the screw 33**.

Figure 5:
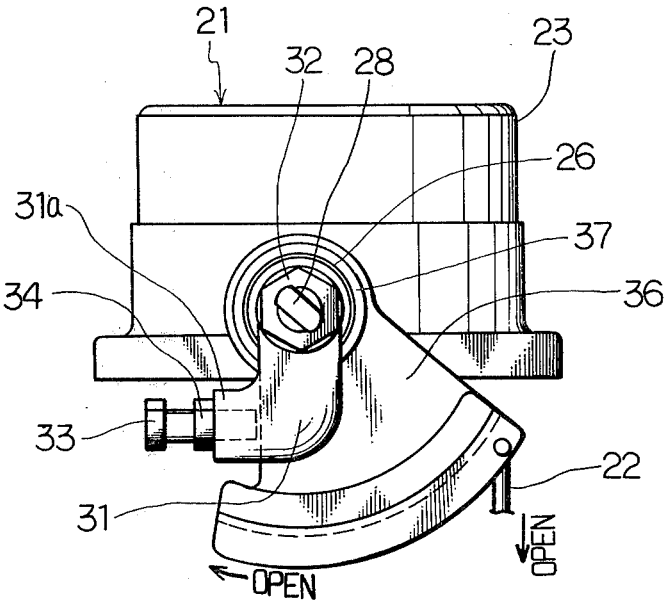
FIG. 5 is a side elevation of the throttle valve.
Figure 6:
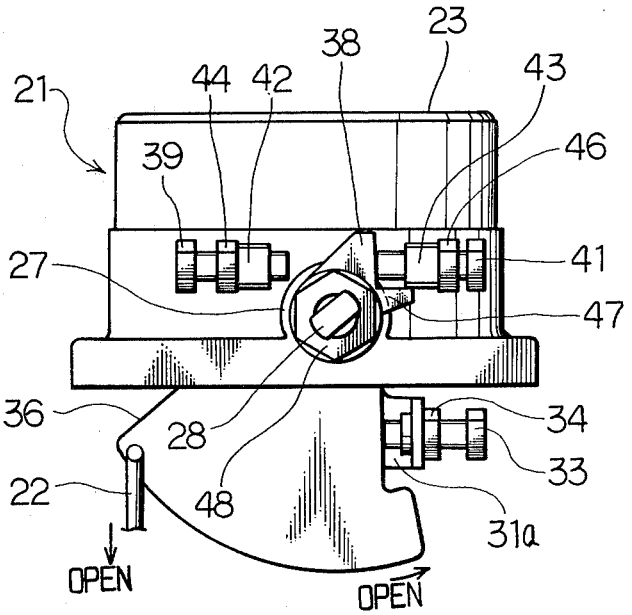
FIG. 6 is a side elevation of the throttle valve viewed from the other side.

On the other side of the housing 23, as best viewed in FIG. 6, is provided a stopper arm 38 which is fixed to the shaft 28. The left and right edges of the arm 38 are engageable with adjusting screws 39 and 41 threaded through stopper lugs 42 and 43 respectively which extend from the housing 23. The screws 39 and 41 are locked in their desired positions by means of locknuts 44 and 46 respectively. Rotatably supported about the shaft 28 is an arm 47. A nut 48 prevents the arm 47 from detaching from the shaft 28. A torsion spring 49 connected between the arms 38 and 47 urges the arm 47 counterclockwise into abutment with the stopper lug 43 and urges the stopper 38 clockwise into abutment with the screw 41, as viewed in FIG. 6. Since the arm 38 is fixed to the shaft 28 and valve plate 29, it will be seen that the spring 49 urges the throttle plate 29 in the closing direction. As viewed in FIG. 5, it will be seen that the spring 49 urges the arm 31 and screw 33 toward the arm 36.

In operation, the amount of fuel injection is determined by the position of the fuel control member 13. Since the arm 36 is connected to the fuel control member 13 through the link 22, the arm 36 is rotatably positioned by the fuel control member 13. As viewed in FIG. 5, as the fuel control member 13 is moved in a fuel increasing direction, the link 22 is moved downwardly and the arm 36 is rotated clockwise.

In accordance with an important feature of the present invention, the arm 36 does not engage the screw 33 until the fuel control member 13 is moved beyond a predetermined position in the fuel increasing direction. FIG. 5 illustrates the case of said predetermined position where the arm 36 just engages the screw 33. With the fuel control member 13 positioned beyond said predetermined position in the fuel decreasing direction, the arm 36 is rotatably positioned counterclockwise of the position illustrated in FIG. 5 and does not contact the screw 33.

After the arm 36 engages the screw 33, a further increase in the amount of fuel injection will cause the arm 36 to rotate further clockwise, but in this case will cause the arm 31, valve shaft 28 and valve plate 29 to also rotate clockwise. This causes the valve plate 29 to unblock the bore 24 to a greater extent, or to further open the valve 21. As a result, the level of vacuum in the induction passageway 18 is reduced and the amount of exhaust gas recirculation decreased.

As viewed in FIG. 6, when the amount of fuel injection is insufficient to cause the arm 36 to engage the screw 33 and arm 31, the arm 38 is held in engagement with the screw 41 by the spring 49. The screw 41 enables adjustment of the minimum opening position of the valve plate 29 through adjustment of the rotational position at which the arm 38 engages with the screw 41. It will be recalled that the arm 38, valve shaft 28 and throttle plate 29 rotate as an integral unit. In accordance with the present invention, the minimum opening position of the valve plate 29 is set to provide optimum exhaust gas recirculation at idling speed. This arrangement positively prevents excessive induction vacuum and exhaust gas recirculation during idling and low speed engine operation.

In an essentially similar manner, the screw 39 limits the maximum degree of opening of the throttle valve plate 29, and may be adjusted as required. Where the engine is decelerated or the load decreased quickly with the accelerator pedal released, the engine will continue to run at high speed for a while and the induction vacuum will be excessively high.

Due to the fact that the valve plate 29 is eccentrically mounted on the valve shaft 28, excessive induction vacuum which exerts a force on the valve plate 29 in excess of the force of the spring 49 causes the valve plate 29 rotate clockwise as viewed in FIG. 5 to a more open position, thereby positively preventing excessive exhaust gas recirculation under such conditions.

More specifically, the pressure difference upstream and downstream of the throttle plate 29 will urge the portions *29a* and *29b* downwardly. However, since the area of the portion *29a* is greater than the area of the portion *29b*, the net result will be a downward force on the portion *29a* causing the throttle plate 29 to rotate to a more open position.

Figure 7:
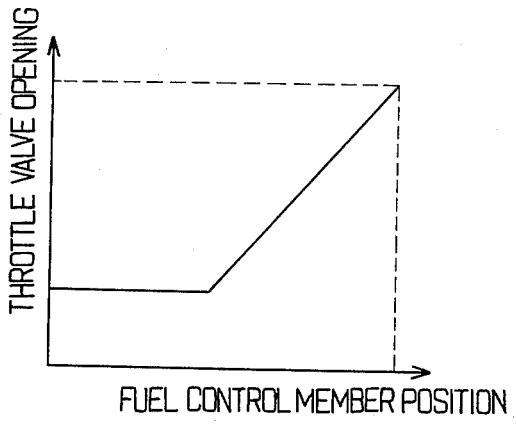
FIG. 7 is a graph illustrating the operation of the present exhaust gas recirculation apparatus.

The operation of the present apparatus 14 is clearly illustrated in FIG. 7. It will be seen that with the amount of fuel injection below a predetermined level, the throttle plate 29 is maintained in engagement with the screw 41 at the optimum degree of opening for idling and low speed operation. As the amount of fuel injection increases beyond the predetermined level, the arm 36 engages the screw 33 and moves the throttle plate 29 to a progressively more open position, decreasing the amount of fuel injection. The screw 33 allows adjustment of the position of the fuel control member 13 at which the arm 36 begins to move the throttle plate 29 in the opening direction.

Futher illustrated in FIG. 2 is a limit switch 51 connected to a valve 53 provided in the passageway 16 through a line 52. The valve 53 is normally open. However, when the amount of fuel injection increases beyond another predetermined level which is higher than the level at which the arm 36 engages the screw 33, the switch 51 is actuated by the control member 13 to close the valve 53 and reduce the amount of exhaust gas recirculation to zero irrespective of the position of the valve plate 29.

In summary, it will be seen that the present exhaust gas recirculation apparatus provides an optimum amount of exhaust gas recirculation under all conditions of engine speed and load. In the low speed range where the speed is controlled by the action of the governor, the amount of exhaust gas recirculation is maintained at an optimum constant value. As the amount of fuel injection increases beyond a predetermined value, the amount of exhaust gas recirculation is progressively reduced. The present invention positively prevents excessive exhaust gas recirculation at low speed and insufficient exhaust gas recirculation at high speed. Various modifications will become possible for those skilled in the art after receiving the teachings of the present disclosure without departing from the scope thereof.

What is claimed is:

1. An exhaust gas recirculation apparatus for an internal combustion engine having a fuel control member, an induction passageway and an exhaust passageway, the apparatus comprising:

a throttle valve movably disposed in the induction passageway;

a recirculation passageway leading from the exhaust passageway to the induction passageway downstream of the throttle valve;

stopper means for limiting movement of the throttle valve in a closing direction; and linkage means connecting the fuel control member to the throttle valve in such a manner that movement of the fuel control member in a fuel increasing direction beyond a predetermined position causes the throttle valve to move in an opening direction.

2. An apparatus as in claim 1, in which the linkage means is constructed to disconnect the fuel control member from the throttle valve at positions of the fuel control member between a minimum fuel position and said predetermined position and to connect the fuel control member to the throttle valve at positions of the fuel control member beyond said predetermined position in the fuel increasing direction.

3. An apparatus as in claim 2, in which the throttle valve comprises a valve shaft which is rotatably supported in the induction passageway and a throttle plate fixed to the valve shaft, the linkage means comprising a first member fixed to the valve shaft and a second member rotatably supported about the valve shaft, the second member being connected to the fuel control member and engaging with the first member only when the fuel control member is moved in the fuel increasing direction beyond said predetermined position.

4. An apparatus as in claim 3, in which the linkage means further comprises an adjustment screw provided to the first member, the second member engaging with the first member through the adjustment screw.

5. An apparatus as in claim 3, in which the first and second members comprise first and second arms respectively.

6. An apparatus as in claim 3, further comprising a spring urging the second member away from the first member.

7. An apparatus as in claim 1, in which the stopper means is further constructed to limit movement of the throttle valve in the opening direction.

8. An apparatus as in claim 7, in which the stopper means comprises a first stopper member fixed to the valve shaft, a second stopper member with which the first stopper member abuttingly engages when moved in the closing direction and a third stopper member with which the first stopper member abuttingly engages when moved in the opening direction.

9. An apparatus as in claim 8, in which the stopper means further comprises first and second adjustment screws provided to the second and third stopper members respectively, the first stopper member comprising an arm which engages with the second and third stopper members through the first and second adjustment screws respectively.

10. An apparatus as in claim 1, further comprising a spring for urging the throttle valve into abutting engagement with the stopper means, the throttle valve being moved away from the stopper means in the opening direction when a difference between induction pressures upstream and downstream of the throttle valve exceeds a predetermined value.

11. An apparatus as in claim 10 in which the throttle valve comprises a valve shaft rotatably supported in the induction passageway and a throttle plate eccentrically fixed to the valve shaft.

12. An apparatus as in claim 1, further comprising a normally open shut off valve disposed in the recirculation passageway, the shut off valve being controlled by the fuel control member in such a manner that movement of the fuel control member in the fuel increasing direction beyond said predetermined position to another predetermined position causes the shut off valve to close.

13. An apparatus as in claim 1, further comprising a fuel injection governor, the fuel control member being positioned by the governor.

14. An apparatus as in claim 13, in which the governor limits the minimum engine speed to a predetermined value.

* * * * *